US006031327A

United States Patent [19]

Lee

[11] Patent Number: 6,031,327

[45] Date of Patent: Feb. 29, 2000

[54] DEFLECTION YOKE HAVING NET SHAPED CORRECTION PROJECTIONS

[75] Inventor: Seok-Moon Lee, Seoul, Rep. of Korea

[73] Assignee: LG Electronics Inc., Seoul, Rep. of Korea

[21] Appl. No.: 08/994,988

[22] Filed: Dec. 19, 1997

[30] Foreign Application Priority Data

Dec. 19, 1996 [KR] Rep. of Korea ..... 96-68048
May 7, 1997 [KR] Rep. of Korea ..... 97-17520

[51] Int. Cl.[7] ..... H01J 29/70

[52] U.S. Cl. ..... 313/440; 313/431; 335/211

[58] Field of Search ..... 313/413, 421, 313/431, 440, 439, 433, 441, 442; 335/210, 213, 296

[56] References Cited

U.S. PATENT DOCUMENTS 4,231,009 10/1980 Barkow ..... 335/212
4,242,612 12/1980 Heijnemans et al. ..... 313/421
4,663,560 5/1987 Oku et al. ..... 313/390
4,823,046 4/1989 Sluyterman ..... 313/431
5,250,876 10/1993 Van Mierlo et al. ..... 313/440
5,847,503 12/1998 Roussel et al. ..... 313/440
5,864,204 1/1999 Ihm ..... 313/440

*Primary Examiner*—Vip Patel
*Assistant Examiner*—Matthew J. Gerike
*Attorney, Agent, or Firm*—Finnegan, Henderson, Farabow, Garrett & Dunner, L.L.P.

[57] ABSTRACT

A deflection yoke for use in a cathode ray tube is disclosed for overcoming a deflection yoke noise problem due to the vibration of a correction projection and simultaneously controlling in an easy manner a local magnetic field adjustment. The deflection yoke includes a net-shaped correction projection for convergence correction formed of a plurality of wires.

5 Claims, 3 Drawing Sheets

DEFLECTION YOKE HAVING NET SHAPED CORRECTION PROJECTIONS

BACKGROUND OF THF INVENTION

A. Field of the Invention

The present invention relates to a cathode ray tube, and more particularly, to a deflection yoke for use in a cathode ray tube including a correction projection for correcting misconvergence.

B. Description of the Prior Art

FIG. 1 is a sectional view illustrating a deflection yoke which is assembled into a representative cathode ray tube. As shown in FIG. 1, the cathode ray tube generally includes an electron gun 11 which emits electron beams of R, G, and B colors, a screen 12 which displays light formed when the emitted electron beams from the electron gun 11 are confronted with a fluorescent screen thereof, a shadow mask 13 which serves to distinguish the three electron beams emitted from the electron gun 11, and a deflection yoke 14 which deflects the electron beam in a predetermined position of the screen 12. In more detail, the deflection yoke 14 is comprised of a horizontal deflection coil 15 for deflecting the electron beam in a horizontal direction of the screen 12, a vertical deflection coil 16 for deflecting the electron beam in a vertical direction of the screen 12, a conical ferrite core 3 for reducing an amount of loss of magnetic force generated in the horizontal and vertical deflection coils 15 and 16 to thereby increase a degree of magnetic efficiency, a holder 2 adapted to secure the above parts at their positions and functioning as an insulating medium between the horizontal and vertical deflection coils 15 and 16.

FIGS. 2A and 2B show the deflection yoke at which a conventional correction projection is attached, wherein FIG. 2A is a sectional view of the deflection yoke and FIG. 2B is a perspective view of the correction projection attached to the outside surface of the holder 2. As shown in FIGS. 2A and 2B, a correction projection 4 made of an iron material is attached to the outside of the holder 2 to locally adjust a vertical deflection magnetic field.

The vertical deflection magnetic field forms, when the correction projection 4 is attached to the deflection yoke in which an convergence error is generated as shown in FIG. 4(*a*), a local vertical deflection barrel magnetic field as shown in FIG. 3. A convergence characteristic by such the vertical deflection barrel magnetic field allows the R and B electron beams to be identified with each other in both the horizontal and vertical directions, as shown in FIG. 4(*b*), and thus compensates the generated convergence error, thereby achieving a good quality of screen.

However, the method for correcting convergence error in the conventional deflection yoke at which the correction projection 4 of an iron material with a predetermined length and thickness is attached has the following problems:

First, since the correction projection 4 of an iron material has a predetermined length and thickness, when the horizontal deflection magnetic field is applied to the correction projection 4, the correction projection 4 is vibrated due to its characteristic vibration and when the deflection yoke operates for a long period of time, noises in the deflection yoke occur due to the vibration of the correction projection generated from the magnetic field applied thereto.

The deflection yoke noise problem due to the vibration of the correction projection 4 is particularly serious in a large size of screen and a high resolution cathode ray tube, since the current difference applied to the deflection yoke in such a screen and cathode ray tube is great and thus the strength of the horizontal and vertical deflection magnetic fields is relatively increased. As a result, the above problem finally results in malfunctions of the cathode ray tube and the deflection yoke therein.

Second, since the correction projection 4 is comprised of an iron material, when it is necessary to alter the shape of the correction projection in response to the demand of a partial alteration of the vertical deflection magnetic field due to the characteristic variation of the deflection yoke, the steps of manufacturing a new correction projection molding and correcting the holder for securing the new correction projection is required, resulting in the time consumption as well as increased production cost.

SUMMARY OF THE INVENTION

An object of the present invention is to obviate one or more of the problems due to limitations and disadvantages of the related art.

Accordingly, an object of the invention is to provide a deflection yoke for use in a cathode ray tube which can overcome a deflection yoke noise problem due to the vibration of a correction projection and also control in an easy manner a local magnetic field adjustment.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

To achieve the objects and in accordance with the purpose of the invention, as embodied and broadly described herein, the invention comprises a holder; and a net-shaped correction projection coupled to the holder for convergence correction including a plurality of wires.

It is to be understood that both the foregoing general description and the following detailed description are exemplary and explanatory only and are not restrictive of the invention, as claimed.

The accompanying drawings, which are incorporated in and constitute a part of this specification, illustrate embodiments of the invention and together with the description, serve to explain the principles of the invention.

BRIEF DESCRIPTION OF THE DRAWINGS

FIGS. 2A and 2B show the deflection yoke at which a conventional correction projection is attached, wherein FIG. 2A is a sectional view of the deflection yoke and FIG. 2B is a perspective view of the correction projection attached to the outside surface of the holder.

FIG. 4(*a*) before attaching the correction projection and FIG. 4(*b*) after attaching the correction projection.

DETAILED DESCRIPTION OF PREFERRED EMBODIMENT

Reference will now be made in detail to the preferred embodiments of the present invention, examples of which are illustrated in the accompanying drawings.

In general, the construction of a deflection yoke constructed according to the present invention is the same as that in the conventional art, except for the net shape of the correction projection, and therefore for the brevity of description, the explanation of the same components will be avoided.

Figure 1:
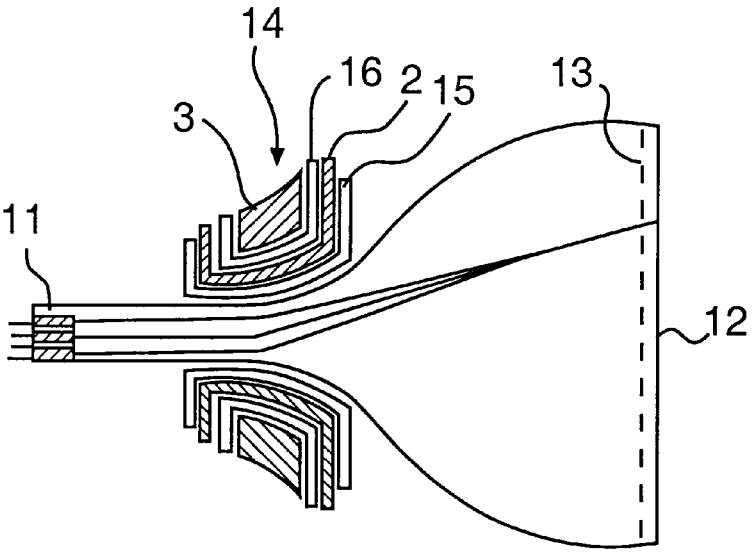
FIG. 1 (PRIOR ART)
FIG. 1 is a sectional view illustrating a deflection yoke which is assembled into a representative cathode ray tube.
Figure 2A:
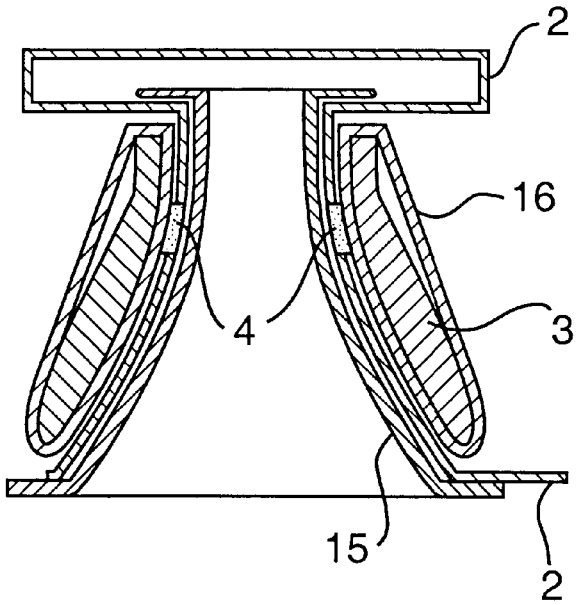
FIG. 2A (PRIOR ART)
Figure 2B:
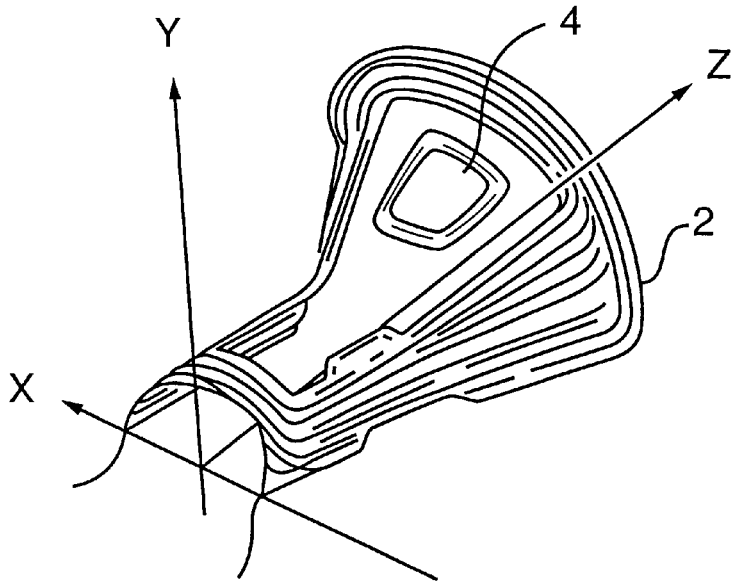
FIG. 2B (PRIOR ART)
Figure 3:
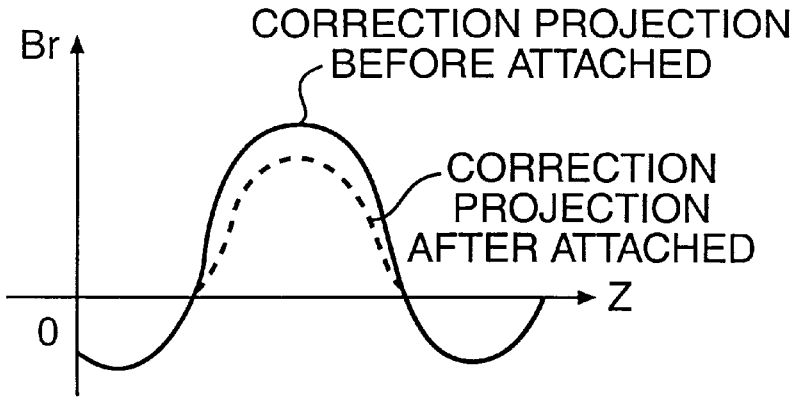
FIG. 3 is a graph illustrating characteristic variations in convergence before and after attaching the correction projection.
Figure 4A:
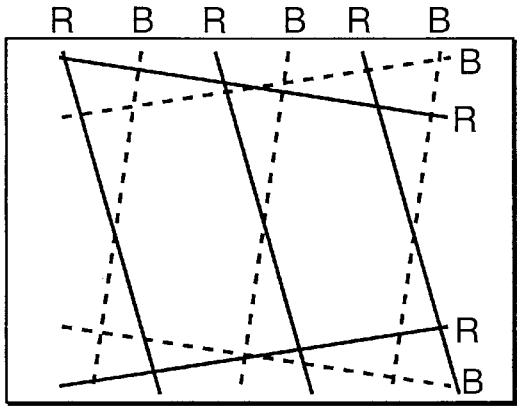
FIGS. 4(*a*) and 4(*b*) show convergence pattern.
Figure 4B:
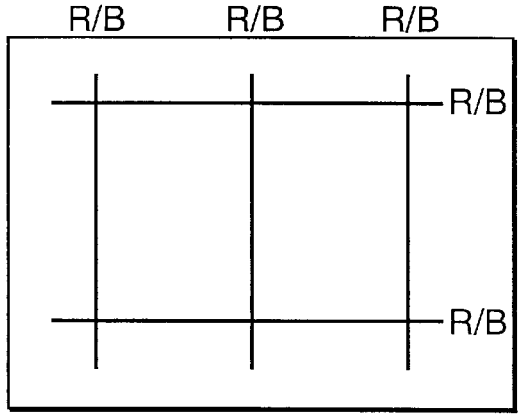
Figure 5:
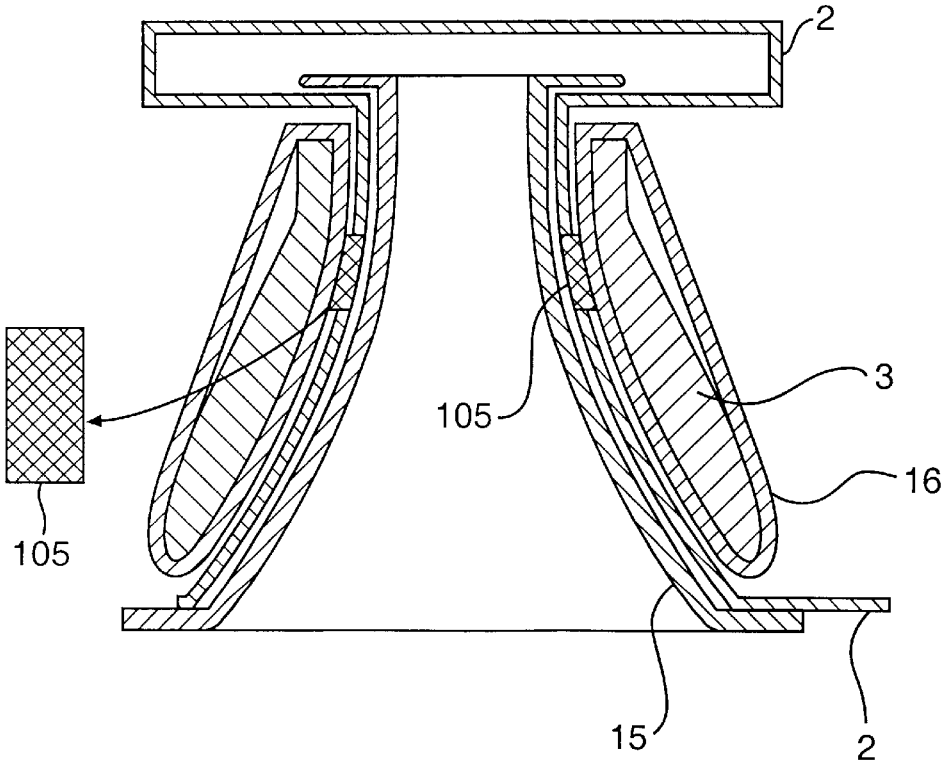
FIG. 5 is a sectional view of the deflection yoke at which a correction projection according to an embodiment of the present invention is attached.

FIG. 5 is a sectional view of the deflection yoke at which a correction projection according to the present invention is attached. As shown in FIG. 5, the deflection yoke, as embodied herein, according to the present invention, includes a horizontal deflection coil 15, a vertical deflection coil 16, a holder 2, a ferrite core 3 and a net-shaped correction projection 105 comprised of a plurality of compact wires. More particularly, the correction projection 105 is subjected to a heat treatment at a high temperature of hydrogen reducing atmosphere of 800 to 1200° C. for a time period from one minute to one hour and is then attached to a groove formed on the outside of the holder 2. The correction projection may be longitudinally attached perpendicular to a pipe axial direction on the outside of the holder. At the time, to prevent the correction projection 105 from being oxidized, the heat treatment of the correction projection 105 is implemented in the hydrogen reducing atmosphere and further to render sizes of crystal grain and magnetic domain large, the heat treatment of the correction projection 105 is implemented at a recrystallization temperature, preferably at a temperature of 800 to 1200° C.

If the temperature of the heat treatment of the correction projection 105 is under the recrystallization temperature, no growth of the crystal grain exhibits. If the heat treatment is implemented at a temperature or 1200° C. or more, the system is soft and if it is executed for a long time period (one hour or more), impurities converge on the crystal grain and thereby the magnetic characteristic of the net shape of correction projection is seriously deteriorated.

Now, an explanation of operation of the deflection yoke constructed according to the embodiments of the present invention will be discussed.

Each of the horizontal and vertical deflection coils 15 and 16 forms a magnetic field and deflects the electron beam emitted from the electron gun 11 in the horizontal and vertical directions. The ferrite core 3 decreases an amount of loss on a feedback path of the magnetic field generated in the horizontal and vertical deflection coils 15 and 16. Specifically, a natural vibration frequency of any object is inversely proportional to the length thereof and directly proportional to the elastic coefficient thereof. However, since the correction projection 105 takes a net shape comprised of a plurality of thin wires in a compact manner, the length of the correction projection 105 is shorter several tens of times than a real length of the correction projection 105. Moreover, since the elastic coefficient of the correction projection 105 is low, the natural vibration frequency thereof is greatly high by several tens of times or is near a value of "0". Furthermore, even if both the horizontal and vertical deflection magnetic fields are simultaneously applied to the correction projection 105, since the correction projection 105 can have a substantial higher natural vibration frequency than that audible by a human body, vibration and noise on the deflection yoke are eliminated.

In addition, the correction projection 105 can greatly reduce a magnetic resistance due to a high temperature of heat treatment and therefore increase a magnetic permeability thereof, which allows the correction rate of misconvergence to increase.

As discussed above, the deflection yoke 105 constructed according to the embodiment of the present invention has the advantages as follows:

First, since the correction projection 105 takes a net shape being comprised of a plurality of thin wires in a compact manner and has a substantially shorter effective length and a very low elastic coefficient, when the horizontal and vertical deflection magnetic field is applied to the correction projection 105 and the deflection yoke operates for a long period of time, the noise on the correction projection 105 due to its characteristic vibration is virtually eliminated. In other words, the current difference applied to the deflection yoke in a large size of screen and a high resolution cathode ray tube is great, but if the correction projection 105 according to the embodiment of the present invention is employed, the deflection yoke noise caused due to the strength increment of the magnetic field can be reduced, thereby achieve an excellent deflection yoke for use in the high resolution applications.

Second, since the shape of the correction projection 105 can be easily altered in response to the demand of a partial alteration of the vertical deflection magnetic field due to the characteristic variation of the deflection yoke, a change in a local vertical deflection magnetic field can be readily made without having an additional molding manufacturing cost.

It will be apparent to those skilled in the art that various modifications and variations can be made in a deflection yoke for use in a cathode ray tube of the present invention without departing from the spirit or scope of the invention. Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A deflection yoke for use in a cathode ray tube, comprising:

a holder; and one or more net-shaped correction projections coupled to said holder for convergence correction, each projection including a plurality of wires.

2. The deflection yoke as defined in claim 1, wherein said holder has a pipe axial direction and said correction projection extends longitudinally in a direction perpendicular to said pipe axial direction.

3. The deflection yoke as defined in claim 1, wherein said correction projection includes a heat treated material.

4. The deflection yoke as defined in claim 3, wherein said heat treated material of said correction projection is treated at a temperature of 800 to 1200° C.

5. The deflection yoke as defined in claim 4, wherein said heat treated material of said correction projection at a temperature of 800 to 1200° C. for a time period from one minute to one hour.

* * * * *